US006508722B1

(12) United States Patent
McCabe et al.

(10) Patent No.: US 6,508,722 B1
(45) Date of Patent: Jan. 21, 2003

(54) GOLF CLUB HEAD AND IMPROVED CASTING METHOD THEREFOR

(75) Inventors: Terrill R. McCabe, Carlsbad, CA (US); Raymond L. Poynor, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/494,385

(22) Filed: Jan. 31, 2000

(51) Int. Cl.[7] ..... A63B 53/04

(52) U.S. Cl. ..... 473/330; 473/342; 473/345

(58) Field of Search ..... 473/290, 291, 473/324, 329, 330, 331, 334, 342, 345, 346, 349, 350, 131

(56) References Cited

U.S. PATENT DOCUMENTS

| | | | |
|---|---|---|---|
| 1,318,325 | A | 10/1919 | Klin |
| 1,319,233 | A | 10/1919 | Mattern |
| 1,467,435 | A | 9/1923 | Kinnear |
| 1,525,352 | A | 2/1925 | Aitken |
| 1,543,691 | A | 6/1925 | Beat |
| 1,582,836 | A | 4/1926 | Link |
| 1,589,363 | A | 6/1926 | Butchart |
| 1,595,589 | A | 8/1926 | Tyler |
| 1,605,551 | A | 11/1926 | Mattern |
| 1,699,874 | A | 1/1929 | Buhrke |
| 1,704,119 | A | 3/1929 | Buhrke |
| 1,704,165 | A | 3/1929 | Buhrke |
| 1,720,867 | A | 7/1929 | Webster et al. |
| 2,034,936 | A | 3/1936 | Barnhart |
| 2,087,685 | A | 7/1937 | Hackney |
| 3,567,228 | A | 3/1971 | Lynn |
| 3,571,900 | A | 3/1971 | Hardesty |

(List continued on next page.)

FOREIGN PATENT DOCUMENTS

| | | |
|---|---|---|
| CN | 1114911 | 1/1996 |
| GB | 2268693 A | 1/1994 |
| GB | 2331938 A | 6/1999 |
| JP | 59207169 | 11/1984 |
| JP | 61033682 | 2/1986 |
| JP | 61162967 | 7/1986 |
| JP | 61181477 | 8/1986 |
| JP | 61185281 | 8/1986 |
| JP | 61240977 | 10/1986 |
| JP | 1244770 | 9/1989 |
| JP | 4020357 | 1/1992 |
| JP | 4327864 | 11/1992 |
| JP | 5212526 | 8/1993 |
| JP | 6007487 | 1/1994 |
| JP | 6114126 | 4/1994 |
| JP | 6126002 | 5/1994 |
| JP | 6154367 | 6/1994 |
| JP | 6182005 | 7/1994 |

(List continued on next page.)

OTHER PUBLICATIONS

Golf Digest, Sep., 1982, p. 25.
Golf Digest, Dec., 1981, p. 58–59.
"Variable Face Thickness Technology," Calloway Golf advertisement, undated.

*Primary Examiner*—Sebastiano Passaniti
(74) *Attorney, Agent, or Firm*—Swidler Berlin Shereff Friedman, LLP

(57) ABSTRACT

The present invention relates to a golf club head casting provided with an internal perimetral welt about the club face. During the club head casting process, the thermomechanical behavior of the casting allows differential cooling across the club face. The face cools at a different rate than the welt, thereby allowing the exterior surface of the face to be maintained in a generally convex shape. Thus, a close-tolerance casting that conforms to preselected face tolerance specifications may be produced.

9 Claims, 5 Drawing Sheets

U.S. PATENT DOCUMENTS

| | | | | | |
|---|---|---|---|---|---|
| 3,625,518 | A | | 12/1971 | Solheim | |
| 3,659,855 | A | | 5/1972 | Hardesty | |
| 3,863,932 | A | | 2/1975 | Lezatte | |
| 3,985,363 | A | | 10/1976 | Jepson et al. | |
| 4,023,802 | A | | 5/1977 | Jepson et al. | |
| 4,193,601 | A | | 3/1980 | Reid, Jr. et al. | |
| 4,213,613 | A | | 7/1980 | Nygren | |
| 4,214,754 | A | | 7/1980 | Zebelean | |
| 4,367,878 | A | * | 1/1983 | Schmidt | |
| D267,965 | S | | 2/1983 | Kobayashi | |
| 4,429,879 | A | | 2/1984 | Schmidt | |
| 4,432,549 | A | * | 2/1984 | Zebelean | |
| 4,438,931 | A | * | 3/1984 | Motomiya | |
| 4,449,707 | A | | 5/1984 | Hayashi et al. | |
| 4,451,041 | A | | 5/1984 | Hayashi et al. | |
| 4,451,042 | A | | 5/1984 | Hayashi et al. | |
| 4,465,221 | A | | 8/1984 | Schmidt | |
| 4,471,961 | A | | 9/1984 | Masghati et al. | |
| 4,489,945 | A | | 12/1984 | Kobayashi | |
| 4,511,145 | A | | 4/1985 | Schmidt | |
| 4,762,324 | A | | 8/1988 | Anderson | |
| 4,792,140 | A | | 12/1988 | Yamaguchi et al. | |
| 4,826,172 | A | | 5/1989 | Antonious | |
| 4,842,243 | A | | 6/1989 | Butler | |
| 4,913,438 | A | | 4/1990 | Anderson | |
| 4,915,385 | A | | 4/1990 | Anderson | |
| 4,915,386 | A | | 4/1990 | Antonious | |
| 4,919,430 | A | | 4/1990 | Antonious | |
| 4,919,431 | A | | 4/1990 | Antonious | |
| 4,921,252 | A | | 5/1990 | Antonious | |
| 4,930,781 | A | | 6/1990 | Allen | |
| 4,932,658 | A | | 6/1990 | Antonious | |
| 4,955,610 | A | | 9/1990 | Creighton et al. | |
| D312,858 | S | | 12/1990 | Anderson et al. | |
| 5,000,454 | A | | 3/1991 | Soda | |
| 5,024,437 | A | | 6/1991 | Anderson | |
| 5,028,049 | A | | 7/1991 | McKeighen | |
| 5,046,733 | A | | 9/1991 | Antonious | |
| 5,056,705 | A | | 10/1991 | Wakita et al. | |
| 5,060,951 | A | | 10/1991 | Allen | |
| 5,067,715 | A | | 11/1991 | Schmidt et al. | |
| 5,090,702 | A | | 2/1992 | Viste | |
| 5,094,383 | A | | 3/1992 | Anderson et al. | |
| 5,106,094 | A | | 4/1992 | Desbiolles et al. | |
| 5,141,230 | A | | 8/1992 | Antonious | |
| 5,163,682 | A | | 11/1992 | Schmidt et al. | |
| 5,180,166 | A | | 1/1993 | Schmidt et al. | |
| 5,183,255 | A | | 2/1993 | Antonious | |
| 5,213,328 | A | | 5/1993 | Long et al. | |
| 5,221,087 | A | | 6/1993 | Fenton et al. | |
| 5,240,252 | A | | 8/1993 | Schmidt et al. | |
| 5,242,167 | A | | 9/1993 | Antonious | |
| 5,255,918 | A | | 10/1993 | Anderson et al. | |
| 5,261,663 | A | | 11/1993 | Anderson | |
| 5,261,664 | A | | 11/1993 | Anderson | |
| 5,271,621 | A | | 12/1993 | Lo | |
| 5,292,129 | A | | 3/1994 | Long et al. | |
| 5,295,689 | A | | 3/1994 | Lundberg | |
| 5,301,945 | A | | 4/1994 | Schmidt et al. | |
| 5,318,300 | A | | 6/1994 | Schmidt et al. | |
| 5,328,184 | A | | 7/1994 | Antonious | |
| 5,344,140 | A | | 9/1994 | Anderson | |
| 5,346,218 | A | | 9/1994 | Wyte | |
| 5,351,958 | A | | 10/1994 | Helmstetter | |
| 5,358,249 | A | | 10/1994 | Mendralla | |
| 5,362,047 | A | | 11/1994 | Shaw et al. | |
| 5,362,055 | A | | 11/1994 | Rennie | |
| 5,377,986 | A | * | 1/1995 | Viollaz | |
| 5,390,924 | A | | 2/1995 | Antonious | |
| 5,395,113 | A | | 3/1995 | Antonious | |
| 5,397,126 | A | | 3/1995 | Allen | |
| 5,401,021 | A | | 3/1995 | Allen | |
| 5,405,137 | A | | 4/1995 | Vincent et al. | |
| 5,407,202 | A | | 4/1995 | Igarashi | |
| RE34,925 | E | | 5/1995 | McKeighen | |
| 5,417,419 | A | | 5/1995 | Anderson et al. | |
| 5,417,559 | A | | 5/1995 | Schmidt | 425/186 |
| 5,423,535 | A | | 6/1995 | Shaw et al. | 273/77 A |
| 5,429,357 | A | | 7/1995 | Kobayashi | 273/80.2 |
| 5,431,396 | A | | 7/1995 | Shieh | 273/78 |
| 5,433,440 | A | | 7/1995 | Lin | 273/78 |
| 5,447,307 | A | | 9/1995 | Antonious | 273/80.2 |
| 5,447,309 | A | | 9/1995 | Vincent | 273/169 |
| 5,451,056 | A | | 9/1995 | Manning | 273/167 F |
| 5,460,376 | A | | 10/1995 | Schmidt et al. | 273/167 A |
| 5,467,983 | A | | 11/1995 | Chen | 273/78 |
| 5,470,069 | A | | 11/1995 | Schmidt et al. | 273/167 A |
| 5,474,296 | A | | 12/1995 | Schmidt et al. | 273/167 J |
| 5,482,279 | A | | 1/1996 | Antonious | 273/167 H |
| 5,497,993 | A | | 3/1996 | Shan | 273/167 H |
| 5,505,453 | A | | 4/1996 | Mack | 273/186.2 |
| 5,522,593 | A | | 6/1996 | Kobayashi et al. | 473/349 |
| 5,524,331 | A | | 6/1996 | Pond | 29/527.4 |
| 5,533,729 | A | | 7/1996 | Leu | 473/346 |
| 5,536,006 | A | | 7/1996 | Shieh | 473/342 |
| 5,547,630 | A | | 8/1996 | Schmidt | 264/297.2 |
| 5,549,297 | A | | 8/1996 | Mahaffey | 473/290 |
| 5,564,994 | A | | 10/1996 | Chang | 473/342 |
| 5,584,770 | A | | 12/1996 | Jensen | 473/350 |
| 5,595,552 | A | | 1/1997 | Wright et al. | 473/332 |
| 5,611,741 | A | | 3/1997 | Schmidt et al. | 473/328 |
| 5,611,742 | A | | 3/1997 | Kobayashi | 473/345 |
| D379,393 | S | | 5/1997 | Kubica et al. | |
| 5,626,530 | A | | 5/1997 | Schmidt et al. | 473/324 |
| 5,643,104 | A | | 7/1997 | Antonious | 473/305 |
| 5,643,108 | A | | 7/1997 | Cheng | 473/329 |
| 5,643,110 | A | | 7/1997 | Igarashi | 473/330 |
| 5,649,872 | A | | 7/1997 | Antonious | 473/332 |
| 5,651,409 | A | | 7/1997 | Sheehan | 164/412 |
| 5,655,976 | A | | 8/1997 | Rife | 473/340 |
| 5,669,827 | A | | 9/1997 | Nagamoto | 473/345 |
| 5,669,829 | A | | 9/1997 | Lin | 473/346 |
| 5,681,228 | A | * | 10/1997 | Mikame | |
| D387,113 | S | | 12/1997 | Burrows | |
| 5,695,411 | A | | 12/1997 | Wright et al. | 473/332 |
| 5,709,614 | A | | 1/1998 | Horiba | 473/305 |
| 5,709,615 | A | | 1/1998 | Liang | 473/324 |
| 5,711,722 | A | | 1/1998 | Miyajima et al. | 473/346 |
| 5,716,292 | A | | 2/1998 | Huang | |
| 5,718,641 | A | | 2/1998 | Lin | |
| 5,720,673 | A | | 2/1998 | Anderson | |
| 5,743,813 | A | | 4/1998 | Chen et al. | |
| 5,753,170 | A | | 5/1998 | Muang | |
| 5,755,624 | A | | 5/1998 | Helmstetter | |
| 5,755,627 | A | | 5/1998 | Yamazaki et al. | |
| 5,762,567 | A | | 6/1998 | Antonious | |
| 5,766,092 | A | | 6/1998 | Mimeur et al. | |
| 5,766,094 | A | | 6/1998 | Mahaffey et al. | |
| 5,766,095 | A | | 6/1998 | Antonious | |
| 5,774,970 | A | * | 7/1998 | Huang | |
| 5,776,011 | A | | 7/1998 | Su et al. | |
| 5,807,190 | A | | 9/1998 | Krumme et al. | |
| 5,827,132 | A | | 10/1998 | Bamber | |
| RE35,955 | E | | 11/1998 | Lu | |
| D401,652 | S | | 11/1998 | Burrows | |
| 5,830,084 | A | | 11/1998 | Kosmatka | |
| 5,839,975 | A | | 11/1998 | Lundberg | |
| 5,842,934 | A | | 12/1998 | Ezaki et al. | |
| 5,851,159 | A | | 12/1998 | Burrows | |
| 5,863,261 | A | | 1/1999 | Eggiman | |
| 5,873,791 | A | | 2/1999 | Allen | |

| | | | |
|---|---|---|---|
| 5,873,795 | A | 2/1999 | Wozny et al. |
| D406,294 | S | 3/1999 | Burrows |
| 5,888,148 | A | 3/1999 | Allen |
| 5,890,973 | A | 4/1999 | Gamble |
| D411,272 | S | 6/1999 | Burrows |
| 5,908,357 | A | 6/1999 | Hsieh |
| 5,921,872 | A | 7/1999 | Kobayashi |
| 5,931,746 | A | 8/1999 | Soong |
| 5,935,019 | A | 8/1999 | Yamamoto |
| 5,938,541 | A | 8/1999 | Allen et al. |
| 5,954,596 | A | 9/1999 | Noble et al. |
| 5,961,394 | A | 10/1999 | Minabe |
| 5,967,905 | A | 10/1999 | Nakahara et al. |
| 5,971,868 | A | 10/1999 | Kosmatka |
| 6,280,349 | B1 * | 8/2001 | Cook |

FOREIGN PATENT DOCUMENTS

| | | |
|---|---|---|
| JP | 6269518 | 9/1994 |
| JP | 8168541 | 7/1996 |
| JP | 8243194 | 9/1996 |
| JP | 8280853 | 10/1996 |
| JP | 8280854 | 10/1996 |
| JP | 8294550 | 11/1996 |
| JP | 9028842 | 2/1997 |
| JP | 9047531 | 2/1997 |
| JP | 9154985 | 6/1997 |
| JP | 9168613 | 6/1997 |
| JP | 9192270 | 7/1997 |
| JP | 9192273 | 7/1997 |
| JP | 9239074 | 9/1997 |
| JP | 9239075 | 9/1997 |
| JP | 9248353 | 9/1997 |
| JP | 2717759 | 11/1997 |
| JP | 9294833 | 11/1997 |
| JP | 9299519 | 11/1997 |
| JP | 10024126 | 1/1998 |
| JP | 10024128 | 1/1998 |
| JP | 10085369 | 4/1998 |
| JP | 10118227 | 5/1998 |
| JP | 10137372 | 5/1998 |
| JP | 10155943 | 6/1998 |
| JP | 10258142 | 9/1998 |
| JP | 10263121 | 10/1998 |
| JP | 10323410 | 12/1998 |
| JP | 10337347 | 12/1998 |

* cited by examiner

GOLF CLUB HEAD AND IMPROVED CASTING METHOD THEREFOR

FIELD OF THE INVENTION

The invention relates to a golf club head. More particularly, the invention is related to a golf club head casting provided with an internal perimetral welt about the club face for differential cooling across the face of the club head during manufacture.

BACKGROUND OF THE INVENTION

Metal woods have become extremely popular among golfers. Metal wood heads are fashioned from a variety of metals, including stainless steel, aluminum, and titanium, and are generally produced in investment casting operations in which molten metal is poured into a mold cavity and allowed to solidify.

Many solidification phenomena are known to occur during casting, and it is well known in the casting art that the structure and properties of a casting are directly affected by the shrinkage, cooling rate, and solidification time of the casting material.

Careful design of the mold and molding process allows the production of club heads with internal cavities and complex surfaces to be cast. Various methods and apparatus for producing golf club heads are disclosed in U.S. Pat. No. 4,842,243 to Butler, U.S. Pat. No. 5,056,705 to Wakita et al., U.S. Pat. No. 5,417,559 to Schmidt, U.S. Pat. No. 5,547,630 to Schmidt, and U.S. Pat. No. 5,651,409 to Sheehan, and are herein incorporated by reference.

In castings, defects can occur during the solidification process, especially due to solidification shrinkage as the casting cools. For example, when cooling from liquid to solid state, a low carbon steel typically shrinks 2.5%, while aluminum can shrink in excess of 6.5%. Additionally, as the solid-state casting cools to room temperature it may contract by several more percent. The shrinkage allowance for a steel casting can be one-quarter inch per foot of material.

In general, to account for shrinkage and avoid residual stresses, molds are often designed to limit the amount of restraint imposed on the casting during cooling. Since the casting of most materials will shrink during cooling, cracking and a concomitant low strength may result if the mold provides too much restriction on shrinkage and residual stresses are introduced. The mold should be compliant enough to permit the solidifying metal to contract in a predictable and desired manner. Thus, proper design of a mold and casting, and proper control of the casting process are essential to the production of club heads with consistent properties and dimensions.

Prior art metal club heads are generally produced from separate castings of a head-shell and soleplate. The club head is formed by welding the soleplate to the head-shell, and then finishing the surface of the head in a grinding and polishing operation.

A drawback of the casting process is that it is difficult to consistently cast the desired shape of the club head to a tight dimensional tolerance, accounting for the shrinkage that occurs during cooling. Yet, the proper shape and sizing of the club face is essential to achieving a desired performance in a golf club, especially in a metal wood.

The shape and sizing of a club face is quite complex. For example, the face progression, defined as the distance from the centerline of the shaft or hosel bore to the farthest front portion of the face on its centerline, is known to impact the trajectory of a golf ball. The face angle, defined as the angle of the face to the grounded sole line with the shaft hole perpendicular to the line of flight, impacts loft and direction of the golf ball, and thus the tendency of the ball to hook or slice.

Of great concern are two characteristics of the face, the horizontal face bulge and the vertical face roll. Horizontal face bulge radius is measured from the heel to toe or along the horizontal plane of the face, and is important because it compensates for a golfer's hitting the ball off of the centerline. If a ball is hit at an off-center location, the bulge effectively compensates for the misalignment that would cause hooking or slicing. A typical wood has a horizontal face bulge radius of between 8 and 16 inches.

Vertical face roll radius is measured from the top of the face to the bottom of the face in a vertical position, and this factor affects the trajectory of the ball off the face. A typical wood has a vertical face roll radius of between 12 and 18 inches.

Prior art attempts to cast club heads to exacting specifications, as defined above, have met with poor results because of the thermomechanical behavior of the casting designs. For example, to minimize distortion of the casting during cooling, uniform cross-sections are desirable. Such a design criteria cannot be followed for a golf club head, especially the head of a wood containing an inner cavity. The face of the club head often contains grooving, and in the area near the hosel the cross section is often significantly wider than that of the remainder of the head-shell.

Prior art club head casting designs and casting methods often result in distortion of the shape and size of the clubhead during cooling. This is especially pronounced on the club head face, which although initially cast with an generally convex exterior surface, upon cooling often collapses inward and fails to retain the desired shape due to poor thermomechanical behavior during cooling.

Thus, there is a need for a casting that consistently results in the desired club head shape and sizing. More particularly, there is a need for a club head casting with a club head face having a consistent and predictable shape and size. Specifically, there is a need for a club head casting design and method which possess desirable thermomechanical behavior during cooling resulting in a casting with a face that does not excessively collapse upon cooling from casting temperature to room temperature.

SUMMARY OF THE INVENTION

The present invention relates to a golf club head casting adapted for attachment to a shaft. The golf club head includes a shell having an inner cavity with a head face and body, and a soleplate or crown plate coupled to the shell to form a substantially hollow body. The head face is cast and has an exterior surface, and the golf club head also includes means for thermomechanically stressing the head face during cooling, so that the exterior surface of the face is maintained in a generally convex shape.

Preferably, the golf club head face has a thickness of less than 0.1 inch. The convex shape may have a horizontal face bulge radius of less than 12 inches on at least a portion of the face, and may have a vertical face roll radius of less than 12 inches on at least a portion of the face The convex shape may alternatively have a vertical face roll radius of less than 8 inches on at least a portion of the face, and the head face and body may be cast simultaneously.

In another embodiment, a golf club head includes a homogeneous shell having an inner cavity with a head face and body, and a soleplate or crown plate coupled to the shell to form a substantially hollow body. The head face has an exterior surface and an interior surface, and a perimeter is included along the interior surface with a welt surrounding a substantial portion of the perimeter. Preferably, the welt covers more than 80 percent of the perimeter of the head face.

In a preferred embodiment, the welt covers more than 80 percent of the perimeter. The face may have a thickness between about 0.05 to 0.11 inch, and the welt may have a thickness between about 0.12 to 0.17 inch. In addition, a thickened central area of the head face may vary in thickness between about 0.050 and 0.150 inch.

In another embodiment, a golf club head includes a shell and a plate, the shell defining an inner cavity provided with a head face and a body. The body is provided with an aperture shaped for receiving the plate, and the head face is provided with a perimetral welt portion of a first thickness and a face portion of a second thickness adjacent the welt portion. The first thickness is at least 1.2 times greater than the second thickness. The perimetral welt is configured and dimensioned to cool slower than the central portion to maintain a predetermined face bulge and roll radius. Preferably, the head face thickness is less than 0.1 inch. The head face may have a generally convex shape with a horizontal face bulge radius of less than 12 inches on at least a portion of the face, and may have a vertical face roll radius of less than 12 inches on at least a portion of the face. The generally convex shape may alternatively have a vertical face roll radius of less than 8 inches on at least a portion of the face. The plate may be a soleplate or a crown plate.

The present invention also relates to a method of forming a close-tolerance casting of a golf club head shell. The method includes the steps of: selecting a face shape of a head shell corresponding to at least two face tolerance specifications, selecting a perimetral welt thickness and shape of a head shell to surround the face, forming a casting mold for casting the head shell having the face shape and perimetral welt, casting molten metal into the casting mold to form the head shell, and allowing the face to cool faster than the welt to maintain two face tolerance specifications. The at least two face tolerance specifications may be a horizontal face bulge radius and a vertical face roll radius.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
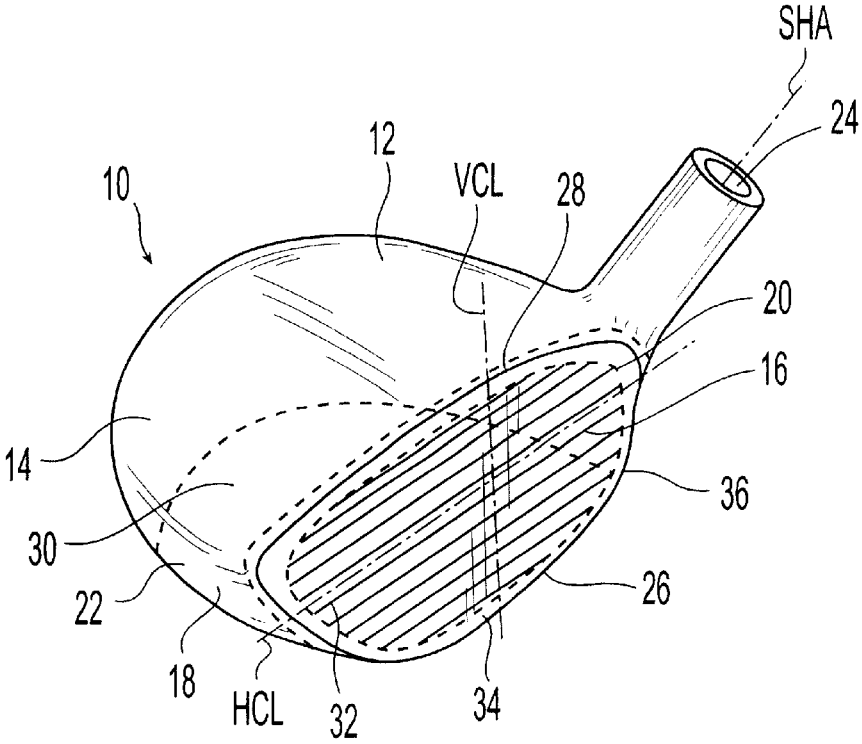
FIG. 1 shows a front perspective view of the golf club head casting of the present invention.

FIG. 1 shows a first embodiment of the golf club head casting 10 of the present invention. Club head 10 includes shell 12 with body 14, toe portion 18, heel portion 20, sole plate 22, hosel 24, bottom portion 26, and top portion 28, and face 16. The sole plate 22, shown in phantom, fits in a recess in the bottom portion 26 of body 14. The shell 12 and sole plate 22 create an inner cavity 30. The face 16 is preferably provided with grooving 32 on its exterior surface 34. A golf club shaft (not shown) is attached at hosel 24 and is disposed along a shaft axis SHA, and the hosel may extend to the bottom of the club head, or may terminate at a location intermediate the top and bottom portions of the head. Inner cavity 30 of club head 10 may be empty, or alternatively may be filled with a foam or other low specific gravity material. Preferably, at least face 16 is cast, and the remainder of the golf club head may be formed by other means. More preferably, shell 12 is cast simultaneously as a body 14 and face 16, forming a homogeneous shell and eliminating the need to bond or otherwise permanently secure a separate face 16 to shell 12.

In an alternate embodiment, shell 12 has a body 14, toe portion 18, heel portion 20, sole plate 22, hosel 24, bottom portion 26, and top portion 28, and face 16. The sole plate is formed integral with shell 12. A crown plate, not shown, is fitted to shell 12, thereby creating a hollow, inner cavity.

Perimetral welt 36, also shown in phantom, is provided about the head face 16. In a preferred embodiment, the welt 36 is formed of additional material around at least a portion of the perimeter of head face 16. The welt is preferably made of the same material as the shell 12 to facilitate casting. Alternatively, the welt may be made of a different material which is also cast in place.

Figure 2:
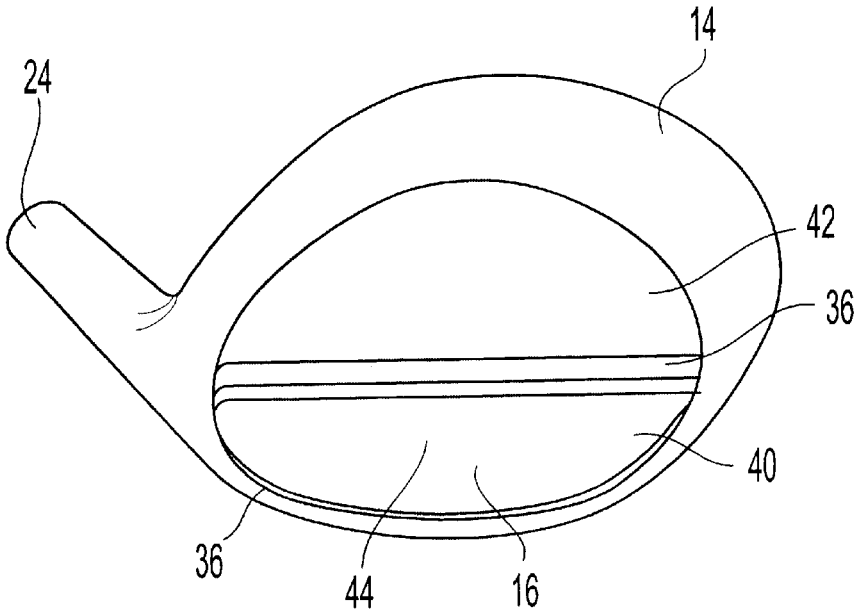
FIG. 2 shows a bottom, perspective view of the golf club head casting with the sole plate removed.

As further seen in FIG. 2, preferably the perimetral welt 36 is formed along the inner edge of head face 16, at the intersection of head face 16 and body 14 on interior surfaces 40 and 42. The welt can contact hosel 24, or is preferably formed such that it is separate from the hosel. The welt can have a variety of cross-sections, including but not limited to arcuate and rectangular forms. The welt 36 may extend along a substantial portion of the perimeter defined at the intersection of face 16 and body 14 on interior surfaces 40 and 42. Preferably, the welt 36 covers more than 80% of the perimeter. In a preferred embodiment, the welt 36 has a generally uniform thickness and cross-section. Alternatively, a plurality of welt portions may be provided along the perimeter, the welt portions having either constant or varying cross-sections.

By locating the perimetral welt 36 at or near the intersection of head face 16 and body 14, the heat transfer characteristics inherent in the geometry permit a desired club head shape to be achieved. All heat transfer modes may be employed to selectively control the cooling of the club head during the entire casting process, including conduction, radiative heat transfer, and convective heat transfer. Thus, for example, even though the perimetral welt may not actually touch head face 16, it may be located in such proximity to the head face to thereby allow other modes of heat transfer to compensate for the detached location and still achieve the necessary temperature differential across the shell to produce the desired final shape.

Figure 3:
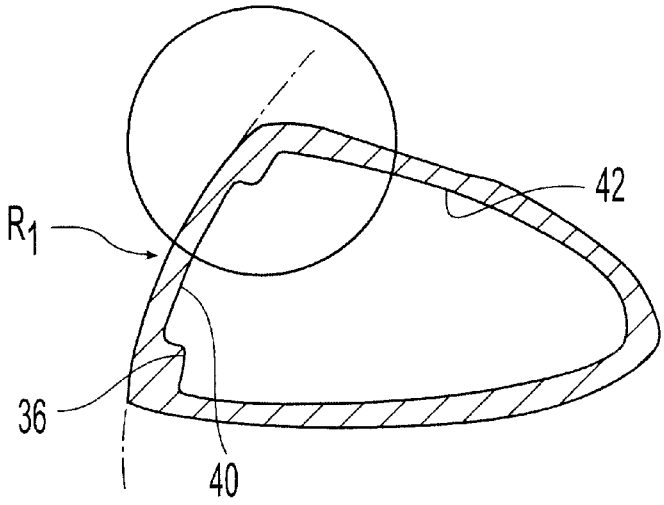
FIG. 3 shows a cross-sectional view of the golf club head casting of FIG. 1.
Figure 3A:
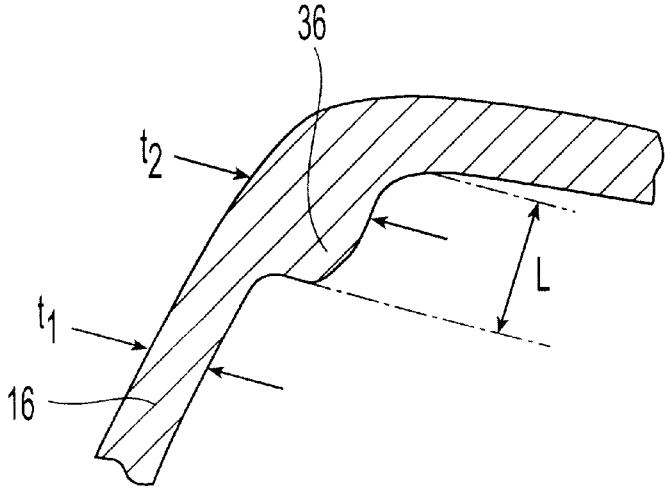
FIG. 3A shows an exploded cross-sectional view of a portion of the golf club head casting of FIG. 3.
Figure 4:
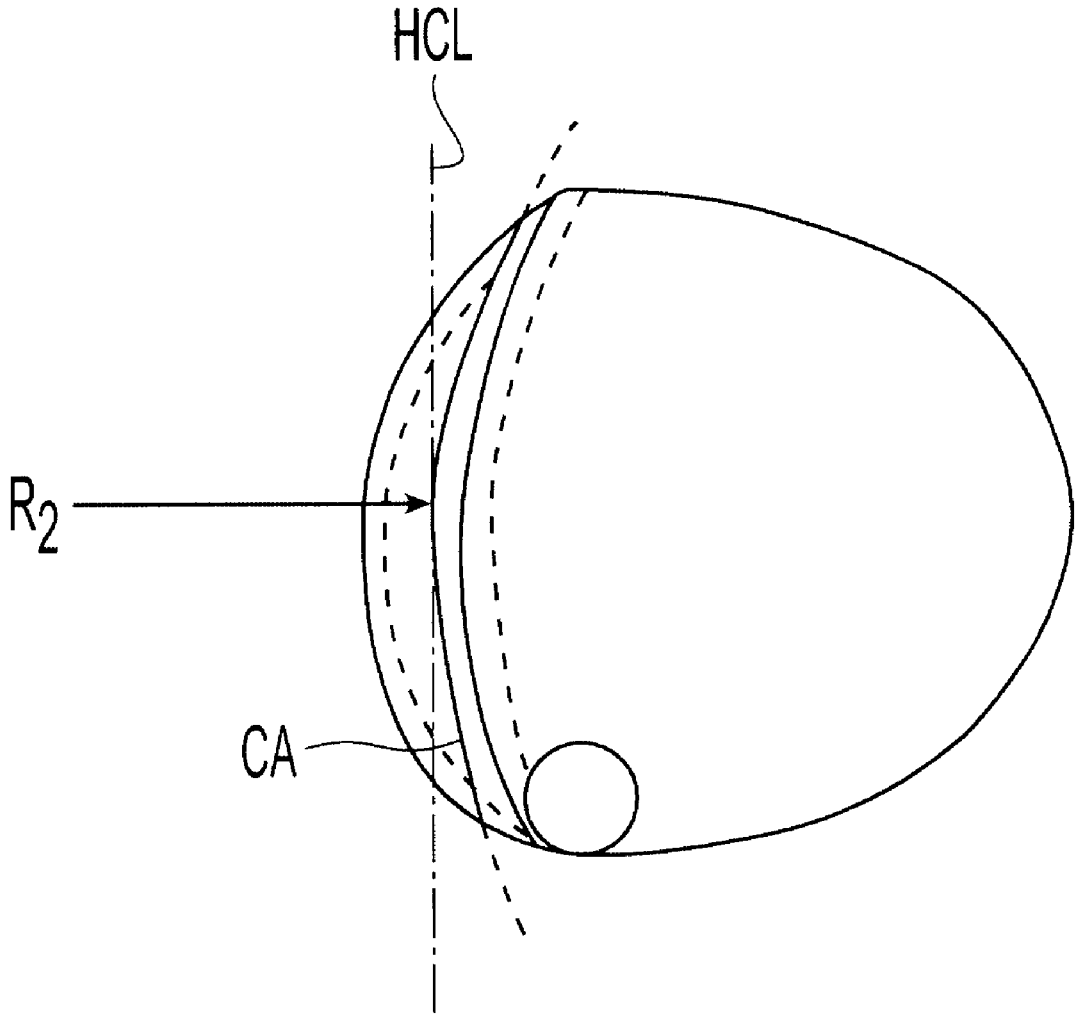
FIG. 4 shows a top, perspective view of the golf club head casting with the perimetral welt indicated in phantom.

As shown in FIGS. 3, 3A, and 4, the desired vertical face roll $R_1$ and horizontal face bulge $R_2$ can be chosen for the head casting so that the casting is shaped as a particular wood. Vertical face roll $R_1$ is the radius of the face at the vertical centerline VCL and the face bulge $R_2$ is the radius of the center arc CA of the face at the horizontal centerline HCL. In the preferred embodiment, welt 36 is provided at the intersection of head face 16 and body 14 on interior surfaces 40 and 42. Head face 16 has a thickness $t_1$ in areas adjacent welt 36; the welt 36 has a thickness $t_2$ and covers a length L of head face 16. Thickness $t_2$ and length L may be substantially equivalent, or one may be larger than the other depending on the desired final geometry of the head face.

Referring to FIG. 2A, the thickness of the club head face $t_1$ is preferably about 0.08 to 0.11 inch. Most preferably, the thickness of the face is less than about 0.10 inch and about 0.09 inch. Moreover, the thickness of the welt $t_2$ is preferably about 0.12 to 0.17 inch, and most preferably about 0.15 inch. The length of the welt L is preferably about 0.10 to 0.25 inch. Most preferably, the length L of the welt is about 0.20 inch.

Preferably, the roll radius $R_1$ will increase with an increase in loft. For example, for a 3 wood, it is preferable to have a roll radius of approximately 5 to 6 inches. In other words, a club head having a loft of approximately 10 to 15 degrees would preferably have a roll radius of around 5 to 6 inches. A 5 wood, a clubhead having a loft of approximately 8 to 25 degrees, would preferably have a larger roll radius of approximately 8 to 10 inches. Thus, all of the clubs in a set or individually preferably have a roll radius of less than 11 inches. More preferably, the clubs with 15 degrees of loft or less have a roll radius of 8 inches or less and clubs with a loft of 16 to 25 degrees have a roll radius of 8 to 11 inches.

Preferably, the bulge radius will increase with an increase in loft. For example, for a 3 wood, a club head having a loft of approximately 10 to 15 degrees, would preferably have a bulge radius of around 8 to 11 inches and preferably about 10 inches. A 5 wood, a club head having a loft of approximately 18 to 25 degrees, would have a bulge radius of approximately 10 to 13 inches. Thus, clubs preferably have a bulge radius of less than 13 inches. More preferably, the clubs with 15 degrees of loft or less have a bulge radius of 10 inches or less and clubs with a loft of 16 to 25 degrees have a bulge radius of 10 to 13 inches.

Figure 5:
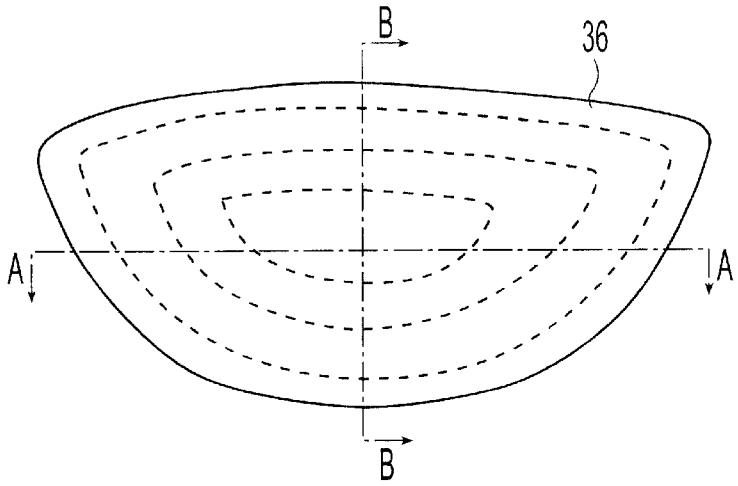
FIGS. 5 shows a front view of the face of the golf club head casting of the present invention.

Although interior surface 40 of head face 16 is shown with a uniform cross-section, a variable cross-section may be provided across the head face. Thus, the central region 44 of head face 16 may have a different thickness than adjacent areas as well as the perimetral welt. As shown in FIGS. 5 to 5B, the thickness of the head face may change in a stepped fashion from a central region with thickness $t_4$ to adjacent regions having thickness $t_3$ and $t_1$ to perimetral welt regions having thickness $t_2$. Preferably, the thickness $t_4 \geqq 1.5\ t_1$, and the thickness $t_4 \leqq t_2$. In another embodiment, the thickness from one region to the next may change gradually. Such a reinforced head face may provide the dual benefits of added structural integrity, which helps prevent permanent deformation of the head face as a result of repeated contact with a golf ball during normal play, as well as additional surface that can be used to control the heat transfer during cooling from initial casting and thereby allow the desired head face curvature to be achieved.

Figure 5A:
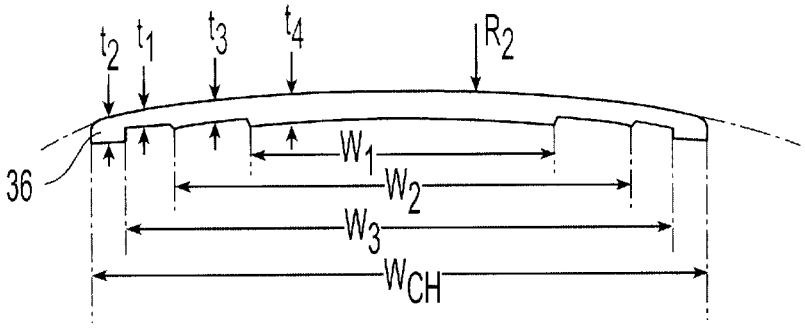
FIG. 5A shows a cross-sectional view of the golf club head casting along line A—A of FIG. 5.
Figure 5B:
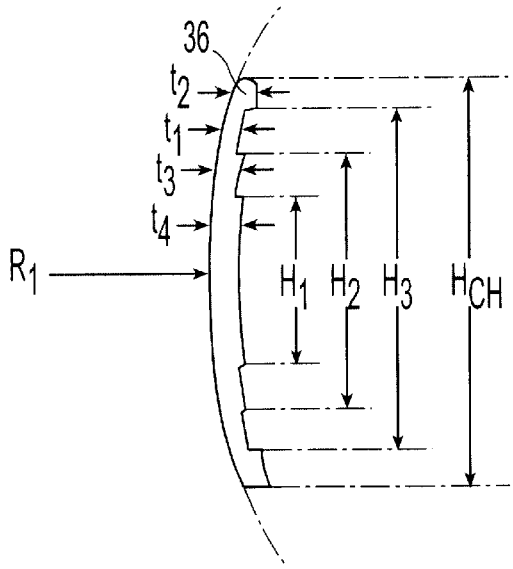
FIG. 5B shows a cross-sectional view of the golf club head casting along line B—B of FIG. 5.

As shown in FIGS. 5, 5A, and 5B, the face 16 may have variable thickness where the thickness of the head face $t_1$ adjacent to the welt 36 is preferably about 0.075 to 0.100 inch. Most preferably, the thickness of the face $t_1$ is about 0.080 inch. The thickness $t_2$ of the welt 36 is preferably about 0.12 to 0.17 inch, and most preferably about 0.150 inch. Several additional thickened areas may be provided, including an inner thickened area with $t_3$ preferably about 0.080 to 0.120, and most preferably 0.100 inch, as well as a central thickened area with $t_4$ preferably about 0.110 to 0.150, and most preferably 0.130 inch.

In a preferred embodiment, the widths of each thickened region are measured along a cross-section taken along a horizontal plane that includes the center of gravity of the club head, and the region widths are related as follows:

$$W_1 < 0.75 W_{CH}$$

$$W_3 - W_2 \geqq 1/6 W_{CH}$$

$$W_{CH} - W_3 \leqq 1/6 W_{CH}$$

The heights of each thickened region are also measured along a cross-section taken along a vertical plane that includes the center of gravity of the club head, and the region heights are related as follows:

$$H_1 < 0.6 H_{CH}$$

$$H_3 - H_2 \geqq 1/6 H_{CH}$$

$$H_{CH} - H_3 \leqq 1/6 H_{CH}$$

It is well known to those skilled in the art that the temperature distribution and heat transfer across a complex surface can be predicted based in part on material properties and geometric considerations. It has long been settled that areas of greater thickness may take longer to cool than areas having a comparatively thin cross-section. However, geometrical considerations may in some designs permit an area to cool at a predictable and enhanced rate. For example, it is well known that the heat transfer inherent to a plane wall configuration can be enhanced through the use of an extended surface, often referred to as a finned surface.

In the preferred embodiment, the size of the welt 36 is chosen based on the thermomechanical characteristics of the golf club head casting. By choosing a welt of a particular size and shape, a casting can be made which displays resilient face roll and face bulge characteristics. In particular, a head face is normally provided with a relatively uniform thickness. In the present embodiment, the welt provides a perimetral area having a thickness greater than the thickness of the adjacent area of the head face. After initial casting, while the newly formed head casting is still cooling from a significantly elevated temperature, the complex geometry of the interior surface of the head face and body results in nonuniform cooling across the club head casting. Of particular relevance is the nonuniform cooling that is obtained across head face 16. Perimetral areas, having a greater thickness than adjacent areas on the head face, take longer to cool. This nonuniform cooling results in the generation of stresses due to the different degrees of thermal contraction that occur across the head face. Such nonuniform thermal contraction stresses in both the longitudinal and transverse directions can advantageously be used to produce the desired curvature of the head face when the casting has cooled to room temperature.

Figure 6:
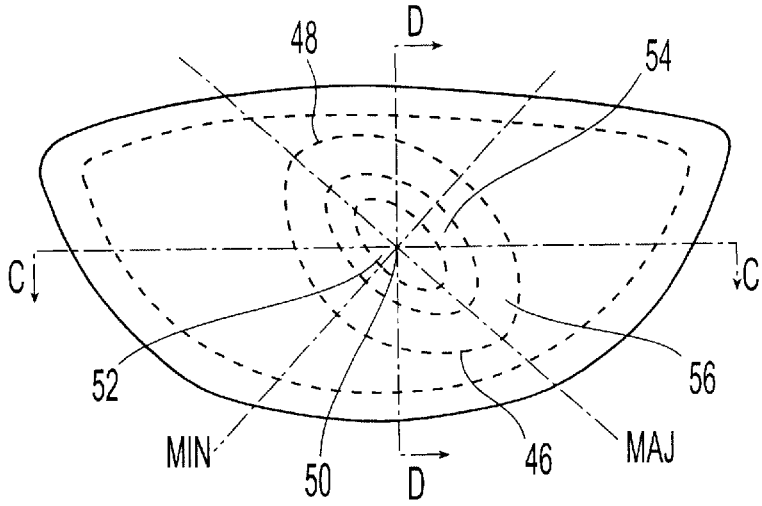
FIGS. 6 shows a front view of the face of another golf club head casting of the present invention.
Figure 6A:
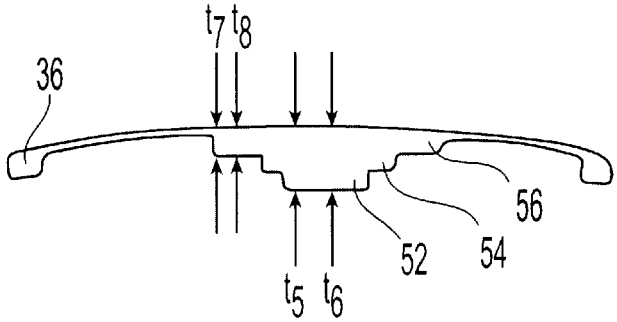
FIG. 6A shows a cross-sectional view of the golf club head casting along line C—C of FIG. 6.
Figure 6B:
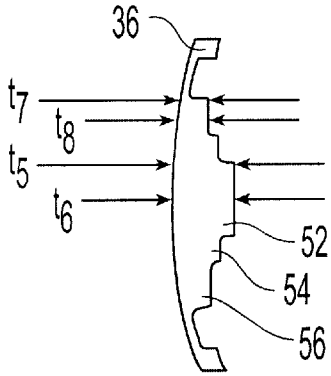
FIG. 6B shows a cross-sectional view of the golf club head casting along line D—D of FIG. 6.

As shown in FIGS. 6, 6A, and 6B, the face 16 may have variable thickness such that some of the thickened sections are not symmetrically shaped with, for example, the shape of head face 16. In the preferred embodiment, one or more elliptically shaped thickened areas are provided on the central region 44 of head face 16. Each elliptical thickened area has a major axis MAJ and a minor axis MIN. For example, the major axis MAJ extends through vertices 46 and 48, with a center point 50 located midway between points 46 and 48. The minor axis MIN extends through center point 50 and is perpendicular to the major axis MAJ. Preferably, axis MAJ is oriented transverse with respect to the shaft axis SHA. Most preferably, axis MAJ is perpendicular to axis SHA, and center point 50 is coaxial with a point defining the center of gravity of the club head casting 10. This orientation of thickened sections balances the club such that if a ball is hit at an off-center location on the face, the club is less likely to rotate about an axis through center point 50 and parallel to shaft axis SHA. Such an orientation also has advantageous vibrational characteristics.

Preferably, each thickened section has a generally constant thickness. For example, thickened section 52 has a constant thickness such that thickness $t_5$ near the section edge is equivalent to thickness $t_6$, and likewise thickened section 56 also has a constant thickness with $t_7$ equivalent to $t_8$. Alternatively, the thickened sections may have a surface curvature such that the thickness varies across the section. The curvature may be ellipsoidal.

In a preferred embodiment, the bulge radius is oriented around the axis MAJ. In addition, the roll radius may be oriented around the axis MIN.

In another preferred embodiment, the roll radius is oriented at an angle from 0 to 35 degrees from the horizontal plane that includes the center of gravity of the face plate.

It may be desired to decrease or eliminate residual stresses that result from the initial thermal processing steps that establish the curvature of the face. Methods for removing such stresses are well-known in the art, and include additional mechanical and thermal treatments.

By initially casting a club head with a perimetral welt having a preselected geometry, the present invention further provides a method of controlling curvature of the head casting as it cools.

A close-tolerance casting of a golf club head shell may be formed by preselecting a face shape of a head shell corresponding to at least two face tolerance specifications. Such specifications include face thickness, horizontal face bulge radius, and vertical face roll radius. Other specifications include, but are not limited to, face progression and face angle. The perimetral welt thickness and head shell shape are also preselected. A corresponding casting mold is formed, and molten metal is cast into the casting mold to form the head shell. The face of the casting is then allowed to cool faster than the welt.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club head casting adapted for attachment to a shaft comprising:

a shell having an inner cavity with a head face and body, the head face being cast and having an exterior surface;

a soleplate or crown plate coupled to the shell to form a substantially hollow body; and means for thermomechanically stressing the head face during cooling, thereby maintaining the exterior surface of the face in a generally convex shape, wherein the head face has a thickness less than 0.1 inch, and wherein the convex shape has a vertical face roll radius of less than 12 inches on at least a portion of the face.

2. The golf club head casting of claim 1, wherein the convex shape has a horizontal face bulge radius of less than 12 inches on at least a portion of the face.

3. The golf club head casting of claim 1, wherein the convex shape has a vertical face roll radius of less than 8 inches on at least a portion of the face.

4. The golf club head casting of claim 1, wherein the head face and body are cast simultaneously.

5. A golf club head comprising a shell and a plate, the shell defining an inner cavity provided with a head face and a body, wherein the body is provided with an aperture shaped for receiving the plate, and the head face is provided with a perimetral welt portion of a first thickness and a face portion of a second thickness adjacent the welt portion, wherein the first thickness is at least 1.2 times greater than the second thickness and the perimetral welt is configured and dimensioned to cool slower than the central portion to maintain a predetermined face bulge and roll radius, wherein the head face has a thickness less than 0.1 inch, and wherein the head face has a generally convex shape with a vertical face roll radius of less than 12 inches on at least a portion of the face.

6. The golf club head of claim 5, wherein the head face has a generally convex shape with a horizontal face bulge radius of less than 12 inches on at least a portion of the face.

7. The golf club head of claim 5, wherein the head face has a generally convex shape with a vertical face roll radius of less than 8 inches on at least a portion of the face.

8. The golf club head of claim 5, wherein the plate is a soleplate.

9. The golf club head of claim 5, wherein the plate is a crown plate.

* * * * *